US007040875B2

(12) United States Patent
Nakano et al.

(10) Patent No.: US 7,040,875 B2
(45) Date of Patent: May 9, 2006

(54) REFRIGERANT PUMP WITH ROTORS IN BEARING

(75) Inventors: Masao Nakano, Shiga (JP); Hiromasa Ashitani, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 237 days.

(21) Appl. No.: 10/410,535

(22) Filed: Apr. 9, 2003

(65) Prior Publication Data

US 2003/0202891 A1 Oct. 30, 2003

(30) Foreign Application Priority Data

Apr. 24, 2002 (JP) ..... 2002-121920

(51) Int. Cl.
*F04B 17/03* (2006.01)

(52) U.S. Cl. ..... 417/410.3; 417/410.4; 417/557; 417/437

(58) Field of Classification Search ..... 417/410.3, 417/410.4, 557, 437
See application file for complete search history.

(56) References Cited

U.S. PATENT DOCUMENTS

| | | | | |
|---|---|---|---|---|
| 3,790,309 | A * | 2/1974 | Volz | 417/368 |
| 4,470,772 | A * | 9/1984 | Gannaway | 417/368 |
| 6,082,984 | A * | 7/2000 | Matsumoto et al. | 418/171 |
| 6,176,691 | B1 * | 1/2001 | Tsubokawa | 417/410.3 |
| 6,203,290 | B1 * | 3/2001 | Tamura et al. | 417/410.3 |
| 6,814,549 | B1 * | 11/2004 | Kimberlin et al. | 417/357 |

FOREIGN PATENT DOCUMENTS

| | | | |
|---|---|---|---|
| JP | 2283887 | * | 11/1990 |
| JP | 403179187 A | * | 8/1991 |
| JP | 4081586 | * | 3/1992 |

* cited by examiner

*Primary Examiner*—Charles G. Freay
*Assistant Examiner*—Emmanuel Sayoc
(74) *Attorney, Agent, or Firm*—RatnerPrestia

(57) ABSTRACT

A refrigerant pump includes a thin-walled hermetic vessel and a thick-walled hermetic vessel having an end inserted into and secured to an end of the thin-walled hermetic vessel. A stator of an electric motor unit is fitted outside the thin-walled hermetic vessel, while a rotor of the electric motor unit is accommodated inside the thin-walled hermetic vessel. A pump mechanism is fitted inside the thick-walled hermetic vessel, and a rotational force of the rotor is transmitted to the pump mechanism by the drive shaft.

1 Claim, 3 Drawing Sheets

REFRIGERANT PUMP WITH ROTORS IN BEARING

BACKGROUND OF THE INVENTION

1. Field of the Invention

The present invention relates to a refrigerant pump for use in a cooling apparatus for cooling a highly exothermic semiconductor element or the like by utilization of a change in phase of a refrigerant between evaporation and condensation thereof.

2. Description of the Related Art

An exemplary refrigerant pump such as disclosed in, for example, Japanese Patent Publication No. 7-47957, first published Nov. 21, 1990 under Publication No. 2-283887, is reproduced in FIGS. 5 and 6 of the accompanying drawings, which illustrate a longitudinal sectional view of the prior art refrigerant pump and a cross-sectional view taken along line A—A in FIG. 5, respectively. As shown in FIGS. 5 and 6, the prior art refrigerant pump utilizes a thick-walled intermediate shell 52 for supporting a pump mechanism 53 that is enclosed within a thin-walled hermetic vessel 51. A rotor of an electric motor unit employed in this prior art refrigerant pump has a plurality of parallel holes 54 defined therein for the flow of a refrigerant therethrough. A suction plate 55 has a suction port 61 defined therein so as to open radially outwardly and is fixedly positioned with the suction port 61 oriented upwardly. A suction tube 56 and a discharge tube 57 are disposed in alignment with the longitudinal axis of the refrigerant pump. In this structure, a pump-side bearing 58 and a cylinder 59 accommodating the pump are separated from each other while a drive shaft 50 is rotatably supported by the suction plate 55.

In the prior art refrigerant pump of the structure discussed above, the intermediate shell is used to alleviate strains that may be developed during welding. However, the use of this intermediate shell is an addition to the number of the component parts, making it difficult to center the drive shaft and the bearing with each other in the face of accumulation of allowances of the component parts. Accordingly, the prior art refrigerant pump under discussion has a problem in that when the drive shaft and the bearing are mounted in a fashion offset relative to each other, the rotational torque tends to increase to such an extent as to result in failure to rotate smoothly. Also, since the assembly is enclosed within the thin-walled hermitic vessel, it requires the drawing process to be performed with utmost care to secure a dimensional accuracy and this is indeed difficult to achieve.

In addition, since the rotor of the electric motor unit is perforated to define the refrigerant passages, an additional problem has arisen in that at a high speed operation the refrigerant will not satisfactorily flow into the refrigerant passages, resulting in a reduction of the amount of the refrigerant being circulated. Yet, since the rotor employed is a direct current motor having magnets inserted therein, it is indeed difficult to secure a space for definition of the refrigerant passages particularly where the rotor has a small diameter. Considering that in the prior art refrigerant pump the suction port in the suction plate has a final suction end defined on the top of the suction plate, there is a good chance that a gas of the refrigerant may enter the refrigerant pump and, once this happens, the amount of the refrigerant being circulated would decrease to such an extent as to result in abrupt drop of the cooling performance. This abrupt drop of the cooling performance does in turn bring about damages to a highly exothermic semiconductor element. In addition, since the suction tube is disposed in alignment with the longitudinal axis of the refrigerant pump, it often occurs that the refrigerant pump may be operated with the gas admixed therein. On the other hand, since the discharge tube is also disposed in alignment with the longitudinal axis of the refrigerant pump, the refrigerant cannot be positively accumulated within the refrigerant pump.

In recent years, demands have arisen to reduce the height of the refrigerant pump particularly where the refrigerant pump is to be incorporated into a rack-type frame structure of a limited height.

Also, since the pump-side bearing and the cylinder are separated from each other, it has been necessary to assemble the refrigerant pump while a careful centering work is performed. Moreover, since the hole in the cylinder is offset from the longitudinal axis of the cylinder, it has been necessary to assemble the refrigerant pump without misalignment.

SUMMARY OF THE INVENTION

Accordingly, the present invention has been devised to eliminate the various problems inherent in the prior art refrigerant pump and is intended to provide a structure of a hermetic vessel that is easy to be machined to a required precision and that is easy to assemble.

Another important objective of the present invention is to increase the reliability of the bearing portion.

A further objective of the present invention is to provide a structure wherein an operation with the gas admixed hardly takes place.

A still further objective of the present invention is to provide a structure in which the height of the refrigerant pump can be suppressed.

In accomplishing the above and other objectives, there is provided a refrigerant pump wherein a pump mechanism is fitted inside a thick-walled hermetic vessel, an end of which is, after having been inserted into an end of the thin-walled hermetic vessel, welded to an interior of the thin-walled hermetic vessel. With this structure, if the dimensional accuracy of the thick-walled hermetic vessel is increased, the centering can easily be achieved.

In the present invention, the drive shaft has a through-hole defined therein to thereby define a refrigerant passage. With this structure, even when at a high speed operation, the amount of the refrigerant being circulated can be secured.

Also, in the present invention, a final end of a suction port defined in a suction plate is provided at a lower portion of the pump mechanism while a suction port for the refrigerant is provided at a top end of a suction-side end plate. This makes it possible to avoid a gas admixing operation. Also, a discharge port for the refrigerant is provided in a discharge-side end plate at a location above the drive shaft and, therefore, it is possible for the refrigerant to be accumulated within the refrigerant pump so that the refrigerant can be sufficiently supplied to the bearing, with the bearing consequently defining a siding bearing.

In the present invention, upper and lower ends of a stator of an electric motor unit are flattened or otherwise cut out, and upper and lower ends of the thick-walled hermetic vessel in which the pump mechanism is accommodated are similarly flattened or otherwise cut out. In this way, the refrigerant pump having a reduced height can be obtained.

Also, in the present invention, a pump-side bearing and a cylinder accommodating the pump are integrated together to provide a cylinder bearing of one-piece structure, and the drive shaft is supported by this cylinder bearing. According to this feature, there is no need to perform a centering between the cylinder and the suction plate and, hence, the pump mechanism easy to assemble can be obtained.

More specifically, the present invention provides a refrigerant pump which includes a thin-walled hermetic vessel, a thick-walled hermetic vessel having an end inserted into and secured to an end of the thin-walled hermetic vessel, and an electric motor unit having a rotor and a stator. The stator is fitted outside the thin-walled hermetic vessel, while the rotor is accommodated inside the thin-walled hermetic vessel. A pump mechanism is fitted inside the thick-walled hermetic vessel. A rotational force of the rotor is transmitted to the pump mechanism by a drive shaft.

As such, the pump mechanism can be highly accurately fixed within the thick-walled hermetic vessel and it is possible to assemble the refrigerant pump of a stable quality in which an exact centering is achieved.

In a preferred embodiment of the present invention, the drive shaft has a through-hole defined therein so as to extend in alignment with a longitudinal axis of the drive shaft. A suction plate is employed having a suction port defined therein so as to extend completely through the suction plate and also having a discharge port defined therein so as to extend towards the longitudinal axis of the drive shaft. In this case, the suction port of a generally crescent shape has a final suction port positioned at a lower portion of the pump mechanism, and the through-hole in the drive shaft and the discharge port are communicated with each other to define a refrigerant passage. This is particularly advantageous in that not only can the refrigerant originating from the pump mechanism be discharged to the outside of the refrigerant pump after having smoothly flown through the drive shaft, but the refrigerant can also be accommodated at the lower end region of the pump mechanism without being admixed with a gas entering the refrigerant pump.

In another preferred embodiment of the present invention, a suction-side end plate has an upper end formed with a refrigerant suction port. Accordingly, even when the gas enters the refrigerant pump, the liquid refrigerant will not be admixed with such gas since the liquid refrigerant is advantageously accommodated in a lower end region of the pump mechanism. Further, a refrigerant discharge tube is secured to a discharge-side end plate at a location above the drive shaft and, hence, the liquid refrigerant is assuredly accumulated in the pump mechanism and is introduced in the bearing portion of the drive shaft, thereby providing a reliable sliding bearing.

In a preferred embodiment of the present invention, upper and lower ends of the stator and corresponding upper and lower ends of the thick-walled vessel accommodating the pump mechanism are flattened. By this design, the refrigerant pump can have a reduced height, thereby enabling the refrigerant pump to be incorporated in a rack-type frame structure.

In a further preferred embodiment of the present invention, a pump-side bearing and a cylinder accommodating a pump are integrated together to define a cylinder bearing of one-piece construction. In this case, the drive shaft is supported by the cylinder bearing. This eliminates the need to perform a centering work and enables the refrigerant pump to be easily assembled without the possibility of the cylinder positioned at an incorrect location.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on an application No. 2002-121920 filed Apr. 24, 2002 in Japan, the content of which is herein expressly incorporated by reference in its entirety.

(Embodiment 1)

Figure 1:
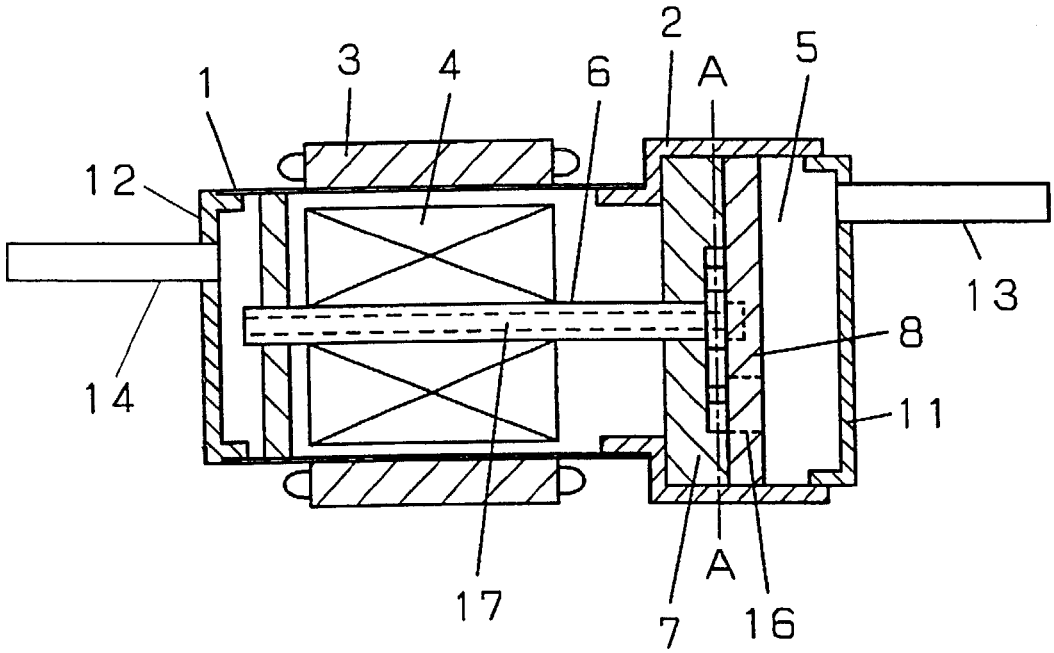
FIG. 1 is a longitudinal sectional view of a refrigerant pump according to a preferred embodiment of the present invention.

Referring first to FIG. 1 showing a refrigerant pump according to a first preferred embodiment of the present invention, a stator 3 of an electric motor unit is fitted to an outside of a thin-walled hermetic vessel 1 and a rotor 4 of the electric motor unit is positioned inside the thin-walled hermetic vessel 1. A rotational force of the rotor 4 is transmitted to a pump mechanism 5 through a drive shaft 6. The pump mechanism 5 is fixed in a thick-walled hermetic vessel 2 having an end inserted into and secured to an end of the thin-walled hermitic vessel 1 in a concentric fashion. The thick-walled hermetic vessel 2 is provided with a suction-side end plate 11 secured thereto, while the thin-walled hermetic vessel 1 is provided with a discharge-side end plate 12 secured thereto. The suction-side end plate 11 is provided with a suction tube 13 having an end fixed to an upper portion of the suction-side end plate 11, while the discharge-side end plate 12 is provided with a discharge tube 14 having an end fixed to a portion of the discharge-side end plate 12 that is positioned above the drive shaft 6. Reference numeral 7 represents a cylinder bearing which concurrently serves as a bearing for the drive shaft 6 and a cylinder defining a pump chamber.

Figure 2:
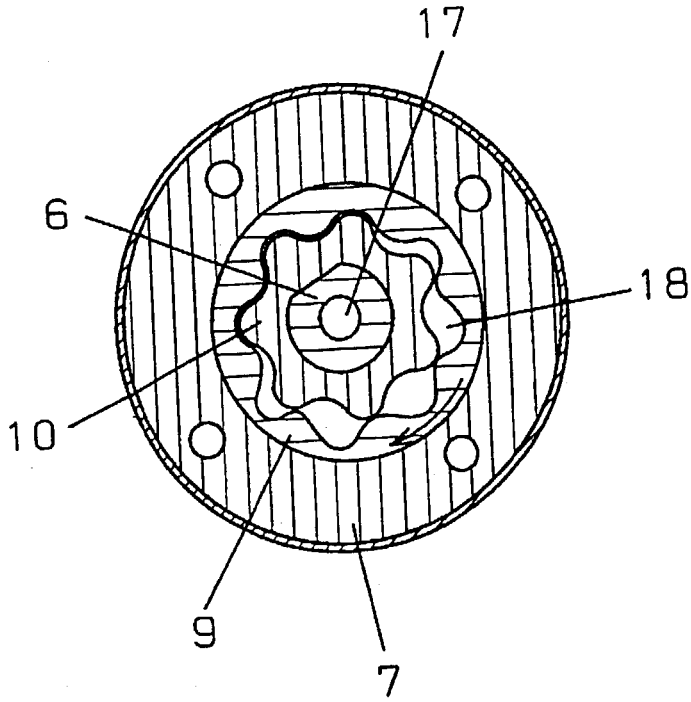
FIG. 2 is a cross-sectional view, on an enlarged scale, taken along the line A—A in FIG. 1.

FIG. 2 illustrates a cross-section of the pump mechanism 5 taken along the line A—A in FIG. 1. As shown therein, the pump mechanism 5 includes, in addition to the cylinder bearing 7, an inner rotor 10 of a shape depicting a trochoid curve and an outer rotor 9 meshed with the inner rotor 10 to define a pump chamber 18 therebetween.

Figure 3:
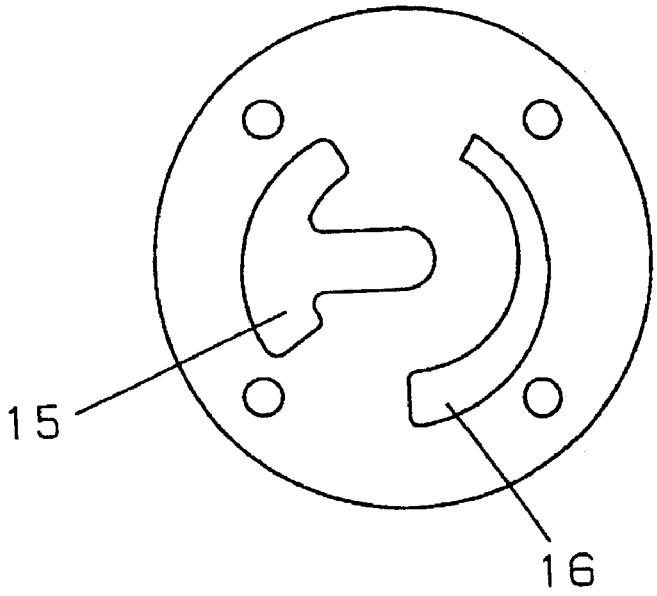
FIG. 3 is a side view of a suction plate used in the refrigerant pump of FIG. 1.

FIG. 3 illustrates a suction plate 8 as viewed from the pump. The suction plate 8 has a generally crescent opening defined therein, which serves as a suction port 16 through which a refrigerant enters the pump chamber 18. The suction port 16 is so positioned that its terminal position is located at a lower portion of the suction plate 8. Reference numeral 15 represents a discharge port that is grooved so as to extend towards a longitudinal axis of the drive shaft 6 and communicated with a longitudinal through-hole 17 defined in the drive shaft 6.

Figure 4A:
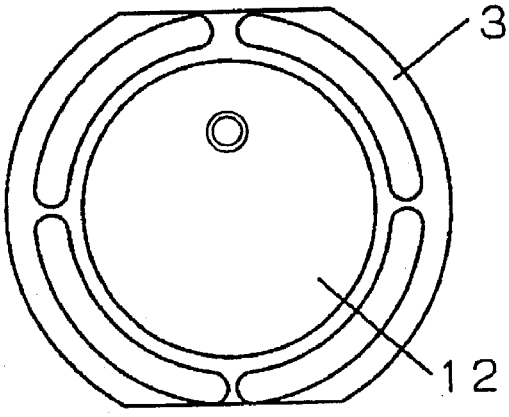
FIG. 4A is a left side view of a refrigerant pump according to another preferred embodiment of the present invention.
Figure 4B:
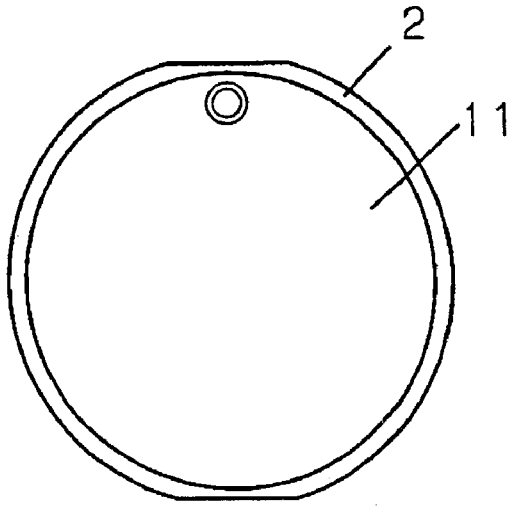
FIG. 4B is a right side view of the refrigerant pump of FIG. 4A.
Figure 5:
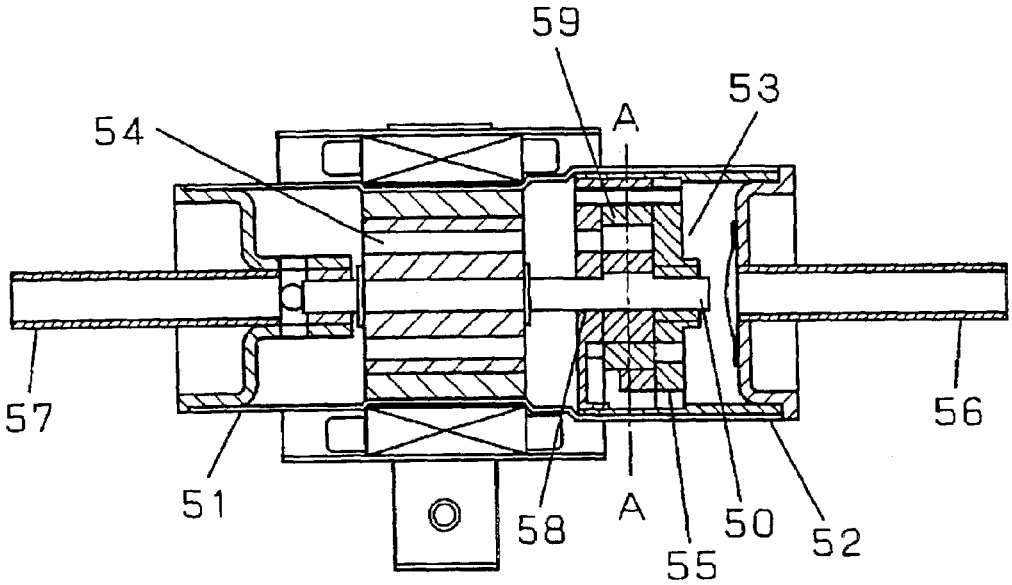
Fig. 5 PRIOR ART
FIG. 5 is a longitudinal sectional view of the prior art refrigerant pump referred to above.
Figure 6:
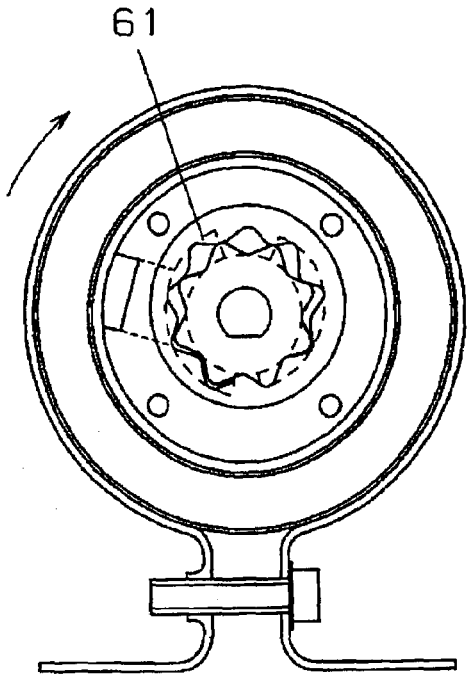
Fig. 6 PRIOR ART
FIG. 6 is a cross-sectional view taken along the line A—A in FIG. 5.

FIG. 4A is a side view of the refrigerant pump of FIG. 1 as viewed from the discharge-side end plate 12, and FIG. 4B is another side view of the refrigerant pump of FIG. 1 as viewed from the suction-side end plate 11. As shown therein, the stator 3 has its upper and lower ends flattened or otherwise cut out, and the thick-walled hermetic vessel 2 similarly has its upper and lower ends flattened or otherwise cut out.

The operation of the refrigerant pump according to the present invention will now be described. When the rotor 4 of the electric motor unit rotates, the drive shaft 6 press fitted into the rotor 4 rotates in unison with the rotor 4. Since as shown in FIG. 2 the drive shaft 6 is engaged in a hole defined in the inner rotor 10, rotation of the drive shaft 6 results in rotation of the inner rotor 10 in a direction shown by the arrow. At this time, the outer rotor 9 is meshed with the inner rotor 10 and, accordingly, the outer rotor 9 rotates in unison with the inner rotor 10 in the direction shown by the arrow. As a result, the pump chamber 18 varies its volume while being rotated in the direction shown by the arrow to thereby perform a pumping action.

When the pumping action takes place in the manner described above, a liquid refrigerant is sucked into the thick-walled hermetic vessel 2 through the suction tube 13. The liquid refrigerant entering the thick-walled hermetic vessel 2 is subsequently sucked into the pump chamber 18 through the suction port 16 in the suction plate 8 and is then, after having been boosted within the pump chamber 18, discharged to the outside of the thin-walled hermetic vessel 1 through the discharge port 15 in the suction plate 8, then through the through-hole 17 in the drive shaft 6 and finally through the discharge tube 14.

In the refrigerant pump according to the foregoing embodiment of the present invention, since the pump mechanism 5 is fitted directly to the inside of the thick-walled hermetic vessel 2, increase of the dimensional accuracy of the thick-walled hermetic vessel 2 makes it possible to secure the perpendicularity of the pump mechanism 5 and, therefore, centering can be easily achieved. Also, since the thick-walled hermetic vessel 2 is, after its end has been inserted into the thin-walled hermetic vessel 1, welded to the thin-walled hermetic vessel 1, a method of fixing the thin-walled hermetic vessel, which is little affected by heat generated during the welding operation, can be obtained.

Also, since in the embodiment discussed hereinabove the through-hole 17 is defined in the drive shaft 6, the amount of the refrigerant being circulated can be secured even when the rotor 4 is driven at a high speed.

In addition, since the terminal of the suction port 16 defined in the suction plate 8 is positioned at the lower portion of the pump mechanism 5, the liquid refrigerant can be accommodated in a lower end region of the pump mechanism 5, even when a gas enters the refrigerant pump and, hence, the gas will not be admixed into the refrigerant pump.

Yet, since the suction tube 13 is positioned at the upper end of the suction-side end plate 11, it can be ensured that only the refrigerant can flow into the lower portion of the pump mechanism 5 even though a mixture of the liquid refrigerant with the gas refrigerant enters the thick-walled hermetic vessel 2.

Furthermore, since the discharge tube 14 is positioned on the discharge-side end plate 12 at a location above the drive shaft 6, the refrigerant can be accommodated within the refrigerant pump to allow the drive shaft 6 to be submerged in the refrigerant so as to define a sliding bearing.

Considering that the upper and lower ends of the stator 3 of the electric motor unit and the corresponding upper and lower ends of the pump mechanism 5 are flattened or otherwise cut out, the refrigerant pump can have a reduced height enough to allow the refrigerant pump of the present invention to be incorporated in a rack-type frame structure.

Yet, since in the foregoing embodiment the pump-side bearing and the cylinder accommodating the pump are integrated together to define the cylinder bearing 7 and the drive shaft 6 is supported by the cylinder bearing 7, no centering between the cylinder and the suction plate 8 is needed and, accordingly, the pump mechanism easy to assemble can be obtained.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein

What is claimed is:

1. A refrigerant pump comprising:

a thin-walled hermetic vessel;

a thick-walled hermetic vessel having an end inserted into and secured to an end of the thin-walled hermetic vessel;

an electric motor unit having a rotor and a stator, the stator being fitted outside the thin-walled hermetic vessel while the rotor is accommodated inside the thin-walled hermetic vessel;

a pump mechanism fitted inside the thick-walled hermetic vessel;

a drive shaft for transmitting a rotational force of the rotor to the pump mechanism;

a suction plate having a suction port defined therein so as to extend completely through the suction plate and also having a discharge port defined therein so as to extend towards a longitudinal axis of the drive shaft, the suction port being of a generally crescent shape having a final suction port positioned at a lower end of the pump mechanism, wherein the drive shaft has a through-hole defined therein so as to extend in alignment with the longitudinal axis of the drive shaft, and the through-hole in the drive shaft and the discharge port are communicated with each other to define a refrigerant passage; and a cylinder bearing of one-piece construction, wherein the pump mechanism comprises an outer rotor and an inner rotor in mesh with each other, the cylinder bearing having a pump-side bearing and a cylinder accommodating the outer rotor and the inner rotor therein, the drive shaft being supported by the cylinder bearing.

* * * * *